United States Patent [19]

Evans

[11] 4,000,893

[45] Jan. 4, 1977

[54] TENNIS RACKET WEIGHT HOLDER AND METHOD OF USE

[76] Inventor: Raleigh Winslow Evans, 1173 W. First St., Columbus, Ohio 43212

[22] Filed: June 2, 1975

[21] Appl. No.: 582,719

[52] U.S. Cl. ..... 273/29 A; 273/73 R

[51] Int. Cl.[2] ..... A63B 69/38

[58] Field of Search ..... 273/26 B, 29 A, 67 A, 273/72 R, 73 R, 73 C, 73 G, 171, 194 B, 189 R, 189 A; 128/166; 272/96

[56] References Cited

UNITED STATES PATENTS

| | | | |
|---|---|---|---|
| 1,729,209 | 9/1929 | Curtice | 272/57 D X |
| 2,241,833 | 5/1941 | Waller | 272/57 D X |
| 2,737,394 | 3/1956 | Abel | 273/194 B |
| 3,306,610 | 2/1967 | Biggs et al. | 272/57 D |
| 3,330,560 | 7/1967 | Higdon | 273/73 R |
| 3,334,898 | 8/1967 | McCrory et al. | 272/57 D |
| 3,427,020 | 2/1969 | Montour et al. | 272/57 D |
| 3,525,141 | 8/1970 | Smith | 272/57 D |
| 3,528,652 | 9/1970 | Tarbox | 272/57 D |
| 3,642,283 | 2/1972 | Wilkens | 273/73 G |

FOREIGN PATENTS OR APPLICATIONS

| | | | |
|---|---|---|---|
| 1,376,724 | 9/1964 | France | 273/73 C |

OTHER PUBLICATIONS

"World Tennis"; June 1975; p. 79.

*Primary Examiner*—Richard J. Apley
*Attorney, Agent, or Firm*—William T. Fryer, III

[57] ABSTRACT

The present invention relates to a tennis racket accessory that adds weight at a selected position on a tennis racket and allows the player to position and remove the weight on tennis rackets of different sizes. The weight holder is made of a flexible material that wraps around a tennis racket handle and overlaps at the ends. The holder comprises two, spaced pockets with a weight in each pocket. The weights are in the shape of a cylinder. Each of the pockets are of sufficient size to permit its weight to roll along the holder lengthwise dimension over a distance that permits the weights to be moved by hand to opposite sides of the racket handle, and movable angularly to line up with the direction of the respective racket handle side.

The holder includes means to fasten the ends together after it has been wrapped around the racket handle. The weights can be tightly pressed against the racket handle sides and the holder retained on the racket handle. The invention further provides method for placing the weight holder on the racket and a method for placing the weight holder on the racket to retain the racket feel.

6 Claims, 6 Drawing Figures

TENNIS RACKET WEIGHT HOLDER AND METHOD OF USE

BACKGROUND

The present invention relates to the field of tennis racket accessories, and more particularly an accessory that adds a weight to a racket at a desired location. The weight is added to the racket to build up the player's muscles.

The flexibility and convenience in use of an accessory for a tennis racket are critical factors from a practical point of view. The weight holder accessory must be convenient to install, remove, and suit the needs of the player. Full development of strength for all types of shots and serving requires that the weight holder not interfere when on the racket. Many tennis players change rackets during a practice session or match, so the weight holder should fit different racket sizes and types.

As far as applicant knows, only two forms of tennis racket weight holders are in general use, now. One type is shown essentially in U.S. Pat. No. 3,330,560, issued July 11, 1967, where the holder is in the form of a case that is laced to the outer end of the racket and the single weight is curved to fit the rounded racket frame.

The other tennis racket weight holder on the market is a weight that comes in two hemispherical pieces, for attachment at the center of the racket head. The pieces are placed on opposite sides at the racket string center, and a fastener connects them together with the strings in the middle. This holder, cannot be used while playing tennis.

Special tennis rackets have been patented, as shown in U.S. Pat. No. 2,215,899, issued Sept. 24, 1940, with a weight in the handle. A mechanism allows the weight to slide inside the handle to adjust the racket balance. These rackets are expensive and complex, and they do not seem to be very popular, now.

Each sport has its unique needs for equipment and the players' demands are different. In the preliminary novelty search on this invention, weight holders used in other sports and activities were found and each of the patents selected for the novelty evaluation and not already cited above, are listed below for consideration by the Patent Office Examiner:

| | |
|---|---|
| U.S. Pat. No. 3,490,766 | Issued January 20, 1970 |
| U.S. Pat. No. 3,521,883 | Issued July 28, 1970 |
| U.S. Pat. No. 3,623,724 | Issued November 30, 1971 |
| U.S. Pat. No. 3,740,053 | Issued June 19, 1973 |
| U.S. Pat. No. 3,716,239 | Issued February 13, 1973 |
| U.S. Pat. No. 3,834,697 | Issued September 10, 1974 |

SUMMARY OF THE INVENTION

The present invention is a weight holder and method of using it, especially designed for a tennis racket. It offers the advantages of easy installation on rackets of various sizes and configurations. It is easy to remove. The weight holder can be placed at a desired location, to retain the feel of the racket for the player. The player can use the racket with the weight holder installed for practice as in a match, without interference or distraction.

These and other advantages that are apparent from the following description are achieved by the present invention that in one embodiment comprises a weight holder made of flexible material. The holder has opposite ends and extends lengthwise a sufficient distance to wrap around a tennis racket handle, with the holder ends overlapping each other. The holder has a width dimension along the racket handle length. The weight holder comprises two, spaced pockets extending in the holder width dimension direction, and each of these pockets has a weight therein. The weight is in the shape of a cylinder with a lengthwise dimension greater than the diameter and the cylinder axis extending generally in the width dimension direction. Each of the pockets is of sufficient size to permit its weight to roll along the holder lengthwise dimension over a distance that permits the weights to be moved by hand to opposite sides of the racket handle and to be properly positioned for the contour of the handle sides. Also, each of the pockets permit the weights to be moveable angularly, to line up with the direction of the respective racket handle side. Each of the holder ends has means to fasten the holder ends together after the holder has been wrapped around the racket handle and the weights are rolled into the aforementioned positions, so that the weights tightly press against the racket handle sides and retain the holder on the handle.

The further construction details of the weight holder are individually unique and permit easy installation at a desired location and quick removal from the holder. The holder has a unique arrangement that allows it to fit various sizes and configurations of rackets.

The method of using this weight holder in one form comprises the steps of loosely wrapping the holder around the racket handle at a location where it is desired to add weight. Each of the weights is rotated in its pocket to move it to press against opposite sides of the handle at a position suitable for the configuration of the handle sides, to maintain the weights in position. Each of the weights is positioned to have its axis parallel to the handle side and extending along the handle length. The wrapping of the holder around the handle is completed, with the holder ends overlapping and fastened, to tightly wrap the holder to the handle. In another form, the method includes positioning the holder to maintain the feel of the racket.

DESCRIPTION OF THE PREFERRED EMBODIMENT

The preferred embodiment of the present invention has been built and tested. It has been demonstrated to be a very practical tennis accessory for a player who want to develop his shoulder, arm and wrist muscles, to improve hitting power and endurance. It has been shown to have the flexibility and adaptability to fit various types of rackets on the market now.

Figure 1:
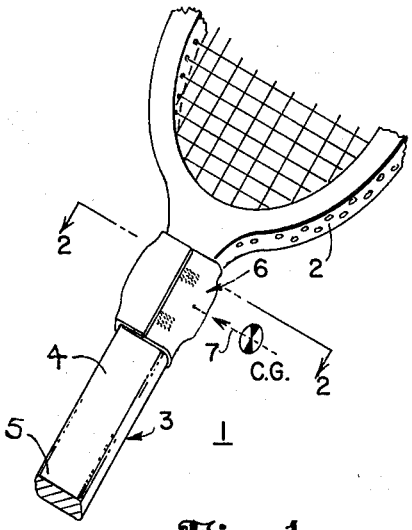
FIG. 1 is a pictorial view of one embodiment of the present invention placed on a wooden type tennis racket to add weight and retain the racket feel.

These and other advantages are illustrated by a description of a preferred embodiment, as shown in FIG. 1. Tennis racket 1 is a standard wooden racket, like a "Bancroft Winner". Only a portion of the racket head 2 and handle 3 are shown, to simplify the drawing. The grip end 5 of handle 3 is connected by the neck 4 to head 2.

Tennis racket 1 can be a practice racket or a match racket. In either case, at times the player may want to change the weight of the racket, to strengthen body muscles, increasing hitting power and endurance. A heavier racket could be used, but it is difficult to match the feel of a player's favorite racket and expensive to keep a racket just for practice. The player may want to use a heavier racket for just a short while, on one or more rackets that are used to warm up.

According to the present invention, racket 1 can be increased in weight by adding weight holder 6 at a desired position on neck 4. Holder 6 is designed to fit at any position on neck 4 and to stay firmly in position while the racket is swung, in practice, or in a match. Since weight holder 6 can be positioned at any location on neck 4, it can be used to give the desired feel that the player wants, so that the racket is swung smoothly and with the same motion used when weight holder 6 is not on the racket. The preferred placement is to locate holder 6 at the balance point 7, identified by arrow 7. Balance point 7 is located by pivoting racket 1 on a finger until the racket remains level. Holder 6 is designed to properly distribute its weight to retain the racket balance point at substantially the same location without holder 6 on racket 1. In this way, racket 1 gives the same feel to the player with or without holder 6. Other tennis racket weight attachment devices mentioned above, under BACKGROUND OF THE INVENTION, do not necessarily offer that option. If desired, the player can locate weight holder 6 at any location on neck 5, to obtain a different feel.

Figure 2:
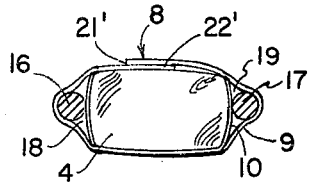
FIG. 2 is a cross-sectional view along the lines 2—2 of FIG. 1, showing the weight holder case and weights in proper position and the holder fastening arrangement.
Figure 4:
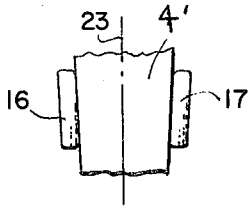
FIG. 4 is a plan view, of a portion of a tennis racket handle, showing the position taken by the weights in the holder case when the handle has inclined sides. The rest of the holder case is not shown, to simplify the illustration.
Figure 5:
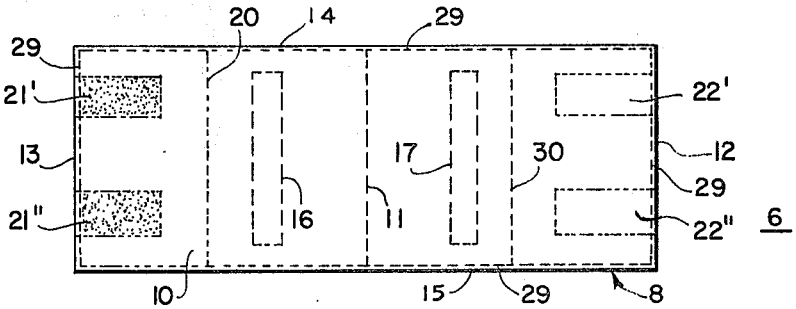
FIG. 5 is a plan view of the weight holder, shown in FIGS. 1, 2, and 3, with the case unfolded, to illustrate the construction of the weight holder.

The arrangement of weight holder 6 is shown in more detail in FIGS. 2 and 5. Holder 6 includes a case 8 formed from a top sheet 9 and bottom sheet 10, rectangular in shape and of flexible material, like imitation leather that does not stretch significantly. In building holder 6, sheets 9 and 10 are laid over each other, and a seam is formed by sewing the sheets together along a line 11 extending midway between the lengthwise opposite edges 12 and 13 of sheets 9 and 10 and at right angles to the widthwise opposite edges 14 and 51. Between sheets 9 and 10 are inserted weights 16 and 17, each weight being in the shape of a cylinder with its axial length extending along the width dimension of holder case 8 and greater than its diameter. Weights 16 and 17 are placed in pockets 18 and 19, respectively, (See FIG. 2) in holder 6, formed by a seam sewed along lines 20 and 30, respectively, on each side of seam line 11 and spaced therefrom. Pockets 18 and 19 are of sufficient size to allow their respective weights 16 and 17 to roll to different positions in the pocket lengthwise along holder case edges 14 and 15, and to incline with respect to seam line 11 at various angles, as shown in FIG. 4, to be described hereinafter.

The construction of holder 6 is completed by a seam completely around sheets 9 and 10 along a border line 29 just inside the outer edge of sheets 9 and 10 and adding a suitable fastener, in the form of Velcro hooks and loops 21 and 22, respectively. Velcro hooks 21 are in two strips 21′ and 21″ spaced apart at holder case end 13 on the outside of sheet 9 and extending lengthwise parallel to holder case edges 14 and 15. Velcro loops 22 are in two strips 22′ and 22″ spaced apart at holder case end 12 on the outside of sheet 10 and extending lengthwise parallel to holder case edges 14 and 15. The Velcro hook and loop strips are arranged to mate, as holder case 8 is wrapped around a tennis racket handle, for various cross-sectional handle dimensions and configurations. This adaptability is the result of the Velcro hook and loop strips 21 and 22 being disposed lengthwise to mate as the holder case ends overlap, no matter how much overlap there is. The Velcro hooks and loops are very firm fasteners, to give a tight grip, while they can be separated by pulling them apart with a modest effort. The outer edges of sheets 9 and 10 can be folded inward to make a smoother edge for holder case 8, or other edge covering techniques can be used.

The use of weight holder 6 will now be described. When a player want to add weight to tennis racket 1, holder case 8 is loosely wrapped around neck 4 at the desired location. Weights 16 and 17 are rolled in pockets 18 and 19, respectively, to the sides of neck 4 (See FIG. 2), to a position midway between the top and bottom edges of the neck sides, and opposite each other. The cylinder shape of weights 16 and 17 is uniquely suited to movement in the pockets and to engage the sides of neck 4 at any point along a line, to provide good contact. Then, holder case 8 is wrapped tightly on neck 4, pressing weights 16 and 17 against the sides of neck 4 in their preselected positions. The holder case end 12 overlaps end 13 and the Velcro hooks and loops engage, to fasten tightly the ends together and firmly wrap weight holder 6 on neck 4.

At any time the player can remove weight holder 6 simply by pulling the overlapping ends apart and unwrapping holder case 8. The weight holder can be repositioned easily at a new location on neck 4. If desired, the feel of the tennis racket can be retained, as if weight holder 6 was not on it, by positioning holder case 8 at the balance point 7. Weights 16 and 17 are of the same weight and dimensions, and identically positioned on either side of neck 4. Holder case 8 is placed at the balance 7 and slid on neck 4 before it is fastened, with the tennis racket 1 resting on a finger, placed at the balance point 7, until the racket stays level. At that position holder 6 is at the balance, with the holder case weight properly distributed on either side of the tennis racket balance point 7. Racket retains its feel, even with the greater weight added by holder case 8.

There are a large number of tennis racket sizes with different handle cross-section dimensions and configurations. The two groups of rackets now on the market are wooden and metal. The present invention allows a player to use the same weight holder on a number of different tennis rackets, both wooden and metal. Quite often a player will change rackets during practice or a match, and this flexibility for a weight holder, plus the convenience of easy removal, are important considerations.

A wooden racket may have substantially parallel, flat neck sides, as on tennis racket 1, or the side may be inclined, as shown in FIG. 4. The center of neck 4' is represented by dashline 23. Weight holder 6 stays firmly on the neck 4'. Weights 16 and 17 are shown to illustrate how they align with the inclined sides to press firmly against them. The size of pockets 18 and 19 allow their respective weights to move to this inclined position as well as being placed at the desired position on the opposite neck sides of neck 4'. One example of a current tennis racket that has the inclined neck sides and on which weight holder 6 fits, as shown in FIG. 4, is the Rawlings, John Newcombe Signature wooden racket.

Figure 3:
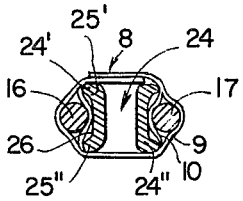
FIG. 3 is a cross-sectional view through the same type weight holder as shown in FIG. 2, except on a metal tennis racket, showing the weight holder case and weights in proper position on the neck, and the holder fastener arrangement.

The other main type of racket now on the market, the metal racket, has a much different general neck configuration and the cross-sectional dimensions and configuration vary from one brand of metal racket to another. A special metal racket neck is shown in FIG. 3 with weight holder 6 on it. The adaptability of weight holder 6 permits use of it on metal rackets of various types. For example, weight holder 6 fits on the Wilson metal racket and the Rawlings metal racket, even though the Rawlings racket has deeper rib grooves and is approximately ⅜ inch wider across the neck than the Wilson racket.

As shown in FIG. 3, a metal racket has a neck 24 that is formed by two metal shafts 24' and 24'', each having a concave side configuration that forms ribs 25' and 25'' and a groove 26. Holder case 8 is loosely wrapped on neck 24, weights 16 and 17 are rolled in their respective pockets 18 and 19 to fit in respective grooves 26, between respective ribs 25' and 25'', and the wrapping is finished to fasten the ends. Holder case 8 fits tightly on the metal racket, just as it fit on the wooden racket 1. The same holder case 8 can be used on a metal racket with a greater width and/or deeper neck groove. The holder case 8 can be positioned to retain the feel of the metal racket, in the manner described above for racket 1.

Figure 6:
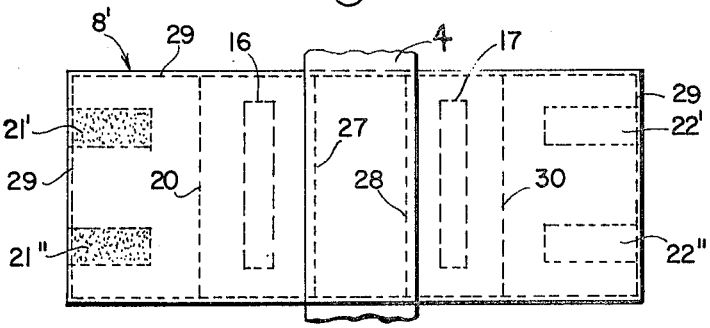
FIG. 6 is a plan view of another embodiment of weight holder in accordance with the present invention, with the case unfolded.

Another embodiment of weight holder in accordance with the present invention is shown in FIG. 6. Weight holder case 8'' in FIG. 6 has less adaptability than holder case 8, but it is quite suitable for tennis rackets of similar neck cross-section dimension and configurations. It uses the same general construction of holder case 8 and for that reason the same reference numbers are used, where appropriate. The chief difference is that holder case 8' designed only to fit tennis racket 1 and rackets with very similar cross-sectional dimensions and configurations. The weight pockets are smaller, restricting the range of lengthwise and inclined movement of the weights.

Holder case 8' is constructed with seams formed along parallel lines 27 and 28, approximately the same distance apart as the width of neck 4. Weights 16 and 17 are in their respective pockets 18 and 19 and they are rolled into position, as described above for holder 8, and holder case 8' is wrapped and fastened.

While there has been described a preferred embodiment and an alternate embodiment, it is apparent to one skilled in the art that the present invention can be constructed using different materials, with other techniques, and take forms. For example, the holder case material need not have a rough outer surface, to reduce sliding of holder 6 on neck 4. The unique construction of holder 6 provides an adequate gripping action. However, the inside sheet 10 can have a rougher outer surface, if desired, for an even better resistance to sliding. In addition, the holder pockets can be modified to allow removal of weights to change the weight size and weight, without departing from this invention. The scope of the invention to be protected is to be determined by the appended claims.

What is claimed is:

1. A tennis racket accessory that adds weight at a selected position on a tennis racket and allows the player to position and remove the weight on tennis rackets of different sizes, comprising a flexible material, said holder having first and second opposite ends and extending lengthwise a sufficient distance to wrap around a tennis racket handle, with said ends overlapping each other, said holder having a width dimension along the racket handle length, said holder comprising two, spaced pockets extending in said width dimension direction, said pockets each having a weight therein, said weight being in the shape of a cylinder with a lengthwise dimension greater than the diameter and having the cylinder axis generally in the width dimension direction, each of said pockets being of sufficient size to permit said weight to roll inside said pocket along the holder lengthwise dimension over a distance that permits each of said weights to be moved inside said pocket by hand to opposite sides of the racket handle and to be properly positioned for the contour of the handle sides, and to be moveable angularly inside said pocket to line up with the direction of the respective racket handle side, means on said overlapable holder ends to removably fasten said ends together after said holder has been wrapped around the racket handle and said weights are rolled in said positions to press tightly said weights against the racket handle sides and retain said holder on said handle.

2. A tennis racket accessory, as described in claim 1, wherein said holder comprising two sheets of flexible, substantially non-stretchable material, each of said sheets having substantially the same length dimensions and width dimensions, one of said sheets overlying the other sheet, the lengthwise dimension of each of said sheets being sufficient to wrap around tennis racket handles of different cross-sectional dimensions and configurations, so that the opposite lengthwise ends of said sheets overlap, said holder sheets being fastened together along a first seam that follows along the outer edge of said sheets, each of said cylinder weights being placed between said strips before said first seam is made, the axial length of said cylinder weights extending in a widthwise direction of said strips and being spaced apart, said sheets being fastened together along a second seam extending spaced from said weight axes and in a widthwise direction of said sheets between said weight axes, thereby forming a pocket for each of said weights, said pockets being of sufficient size to allow each of said cylinder weights to be rolled in said respective pocket in a lengthwise direction of said sheets, to fit different racket handle cross-section dimensions, so that said weights can be spaced on opposite sides of the handle in a position that is most suitable for the particular racket handle configuration, and said sheets then can be wrapped around the racket handle to overlap each other, said fastening means comprising strips to Velcro hook material attached to and spaced apart and extending lengthwise along one of said overlapping holder sheet portions, and Velcro loop mating strips attached to and spaced apart on the other of said overlapping sheet positions to mate with a respective one of said Velcro hook strips, said Velcro hook strips and mating loop strips being arranged to overlap for various racket handle cross-sections dimensions and configurations.

3. A tennis racket accessory, as described in claim 2, wherein, said second seam forms a flat portion on said sheets between said pockets, said flat portion being formed by first and second straight line and parallel connections between said sheets, extending in a width dimension of said sheets, one side of a tennis racket handle fitting against said flat portion as the said weights are rolled in said respective pockets to position them properly against the adjacent handle sides, one of said pockets being formed by said second seam on one edge and a third seam on the other edge of said one pocket, said third seam being spaced from said adjacent widthwise sheet ends, and extending along said sheet width dimension, the other of said pockets being formed by said second seam on one edge and a fourth seam on the other edge, said fourth seam being spaced from said adjacent widthwise sheet ends and extending along said sheet width dimension, said overlapable sheet end portions with said Velcro hooks and loops being formed between one of said lengthwise ends and said third seams on one end and the other of said lengthwise ends and said fourth seam, said Velcro hook strips being attached to one lengthwise end of said sheet, extending in the lengthwise dimension and spaced apart to permit fastening to the mating loops for various amounts of overlap, said Velcro loop strips being attached to the other lengthwise end of said sheets, on the opposite side from said hook strips, and extending in the lengthwise dimension and spaced apart to permit fastening to the mating loops for various amounts of overlap.

4. A tennis racket accessory, as described in claim 2 wherein, one of said pockets is formed by said second seam on one edge and a third seam on the opposite edge, said second seam being a single, straight line connection between said sheets, said third seam being spaced from said adjacent widthwise sheet end and extending along said sheet width dimension and said third seam being a single, straight line connection between said sheets, the other of said pockets being formed by said second seam on one edge and a fourth seam on the opposite edge, said fourth seam being spaced from said adjacent widthwise sheet end and extending along said sheet width dimension, said fourth seam being a single, straight line connection between said sheets, said overlapable sheet end portions with said Velcro hooks and loops being formed between one of said sheet lengthwise ends and said third seam on one end and the other of said lengthwise ends and said fourth seam, said Velcro strips being attached to one lengthwise end of said sheet, extending in the lengthwise dimension and spaced apart to permit fastening to the mating loops for various amounts of overlap, said Velcro loop strips being attached to the other lengthwise end of said sheets, on the opposite side from said hook strips, and extending in the lengthwise dimension and spaced apart to permit fastening to the mating loops for various amount of overlap.

5. A method of using a tennis racket accessory that adds weight at a desired location on the tennis racket handle for racket handles of various cross-sectional dimensions and configurations, said accessory comprising a flexible material holder having first and second opposite ends and extending lengthwise a sufficient distance to wrap around a tennis racket handle, with said ends overlapping each other, said holder having a width dimension along the racket handle length, said holder comprising two, spaced pockets extending in said width dimension direction, said pockets each having a weight therein, said weight being in the shape of a cylinder with a lengthwise dimensions greater than the diameter and having the cylinder axis generally in the width dimension direction, each of said pockets being of sufficient size to permit said weight to roll along the lengthwise dimension in said respective pocket over a distance that permits each of said weights to be moved by hand to opposite sides of the racket handle and to be properly positioned for the contour of the handle sides and to be moveable angularly to line up with the direction of the respective racket handle side, and means on said overlapable holder ends to fasten said ends together after said holder has been wrapped around the racket handle and said weights are rolled into said positions and thereby tightly press said weights against the racket handle sides and retain said holder on said handle, the steps comprising, 1. loosely wrapping said holder around said racket handle at a location where it is desired to add weight,
2. rotating each of said weights in said pockets to move said weights to press against opposite sides of said handle at a position suitable for the configuration of the handle sides, to maintain said weights in position, each of said weights being positioned to have its axis parallel to the handle side and extending along the handle length, and
3. completing the wrapping of said holder around said handle to have said holder ends overlapping fastened, to tightly wrap said holder to said handle.

6. The method, as described in claim 5, wherein said holder is wrapped on said handle at at location where the racket balance point remains the same, with or without said holder on said handle, so that the racket is heavier and has the same feel to the user, said weights being disposed about the handle balance point to provide this balanced condition.

* * * * *